US005754086A

United States Patent [19]

Ichida et al.

[11] Patent Number: 5,754,086

[45] Date of Patent: May 19, 1998

[54] TRANSFORMER UNIT AND COIL CASE AND COIL BOBBIN FOR USE THEREFOR

[75] Inventors: Shigeo Ichida, Motosu-gun; Yuichi Ichikawa, Ibi-gun; Fumio Ichimiya, Gifu; Yoshihiro Matsui, Gifu; Yoshiharu Nonomura, Gifu; Kentaro Masuda, Motosu-gun, all of Japan

[73] Assignee: Kabushiki Kaisha Sanyo Denki Seisakusho, Gifu, Japan

[21] Appl. No.: 190,353

[22] Filed: Feb. 1, 1994

[30] Foreign Application Priority Data

| | | | |
|---|---|---|---|
| Feb. 5, 1993 | [JP] | Japan | 5-019066 |
| Feb. 5, 1993 | [JP] | Japan | 5-019068 |
| Feb. 5, 1993 | [JP] | Japan | 5-019069 |
| Feb. 5, 1993 | [JP] | Japan | 5-019073 |

[51] Int. Cl.[6] ..... H01F 27/02; H01F 27/28

[52] U.S. Cl. ..... 336/96; 336/184

[58] Field of Search ..... 336/184, 94, 96

[56] References Cited

U.S. PATENT DOCUMENTS

| | | | |
|---|---|---|---|
| 3,661,342 | 5/1972 | Sears . | |
| 4,586,016 | 4/1986 | Rilly et al. | 336/96 |
| 4,988,968 | 1/1991 | Tochio et al. | 336/98 |
| 5,124,680 | 6/1992 | Maekawa | 336/96 |
| 5,168,422 | 12/1992 | Duncan | 361/377 |
| 5,266,916 | 11/1993 | Kijima | 336/160 |
| 5,483,405 | 1/1996 | Kaelin | 361/38 |
| 5,485,135 | 1/1996 | Hipp | 336/96 |
| 5,524,334 | 6/1996 | Boesel | 29/605 |
| 5,589,808 | 12/1996 | Clark et al. | 336/92 |

FOREIGN PATENT DOCUMENTS

| | | |
|---|---|---|
| 0485341 | 5/1992 | European Pat. Off. . |
| 3311775 | 6/1984 | Germany . |
| 92 05 183.9 | 12/1992 | Germany . |
| 61-172314 | 8/1986 | Japan . |
| 2005087 | 4/1979 | United Kingdom . |
| 2171562 | 8/1986 | United Kingdom . |
| 2220945 | 1/1990 | United Kingdom . |

*Primary Examiner*—Renee S. Luebke
*Assistant Examiner*—Daniel Chapik
*Attorney, Agent, or Firm*—Pollock, Vande Sande & Priddy

[57] ABSTRACT

For use with a transformer unit comprising a main housing accommodating a transformer, a coil case is provided which encloses a high-voltage coil and the magnetic core section around which said coil is mounted. Only the interior space of the coil case is filled with insulating compound.

11 Claims, 9 Drawing Sheets

TRANSFORMER UNIT AND COIL CASE AND COIL BOBBIN FOR USE THEREFOR

TECHNICAL FIELD

This invention relates to a transformer unit such as a neon transformer or the like, and a coil case and a coil bobbin for use for the transformer unit.

BACKGROUND ART

Conventionally, a transformer having a primary coil and a secondary coil is housed in the main housing of a transformer unit. The primary coil and the secondary coil are wound around a magnetic core forming a closed magnetic circuit. When the main housing is filled with liquid insulating compound, the primary and secondary coils are wrapped in the insulating compound. Subsequently, the insulating compound is cured to encapsulate the entire primary and secondary coils therein, whereby the coils are electrically insulated.

However, according to the method described above, the interior of the entire main housing accommodating devices such as capacitors, resistances, etc. as well as the primary and secondary coils, is fully filled with insulating compound, resulting in a great amount of insulating compound and hence disadvantageously increasing the weight of the transformer unit.

SUMMARY OF THE INVENTION

It is an object of the invention to provide a weight-reduced transformer unit, and a coil case and a coil bobbin suitable for use in the transformer unit.

In the transformer unit according to this invention, primary and secondary coils are wound around a common magnetic core means in spaced apart relation to form a transformer, and the secondary coil and a part of the magnetic core means around which the secondary coil is wound are enclosed in a coil case. The transformer and the coil case are contained in a main housing. Insulating compound is filled only in the coil case.

The coil case used in the transformer unit comprises a box including two opposed side walls having mounting holes formed therethrough. A tubular support member is inserted in said mounting holes to penetrate the coil case, and within the coil case a coil having high voltage terminal pins on opposite ends thereof is mounted around the outer periphery of the tubular support member.

The coil bobbin used in the transformer unit comprises a tubular body and a plurality of spaced apart parallel flanges integral with and extending radially from the outer periphery of the tubular body, each of the flanges having opposed side surfaces and being formed in one of the side surfaces with a communicating groove extending tangentially from adjacent the outer periphery of the tubular body, said communicating groove having a bottom in which is formed a notch extending generally radially inwardly from the outer peripheral edge of the flange, the notch intersecting the other of the side surfaces.

BRIEF DESCRIPTION OF THE DRAWINGS

These and other more detailed and specific objects and features of the present invention will be more fully disclosed in the following specification with reference to the accompanying drawings, in which.

DETAILED DESCRIPTION OF THE PREFERRED EMBODIMENTS

Embodiments in which the present invention is embodied as a transformer unit for use to light a neon gas tube will be described with reference to the drawings.

Transformer units for use with neon signs include two types, one being a transformer for transforming a commercial input AC voltage directly into a high voltage, and the other being a transformer for rectifying a commercial AC voltage to a DC voltage and converting it to a high-frequency voltage by an inverter, followed by transforming the high frequency voltage into a high voltage. The latter type has been more widely employed in recent years because of the possibility of significantly reducing the size of the transformer.

While the embodiments of this invention will be described with reference to the latter type in the following specification, it is to be understood that the invention is equally applicable to the former type of transformer unit.

Figure 1:
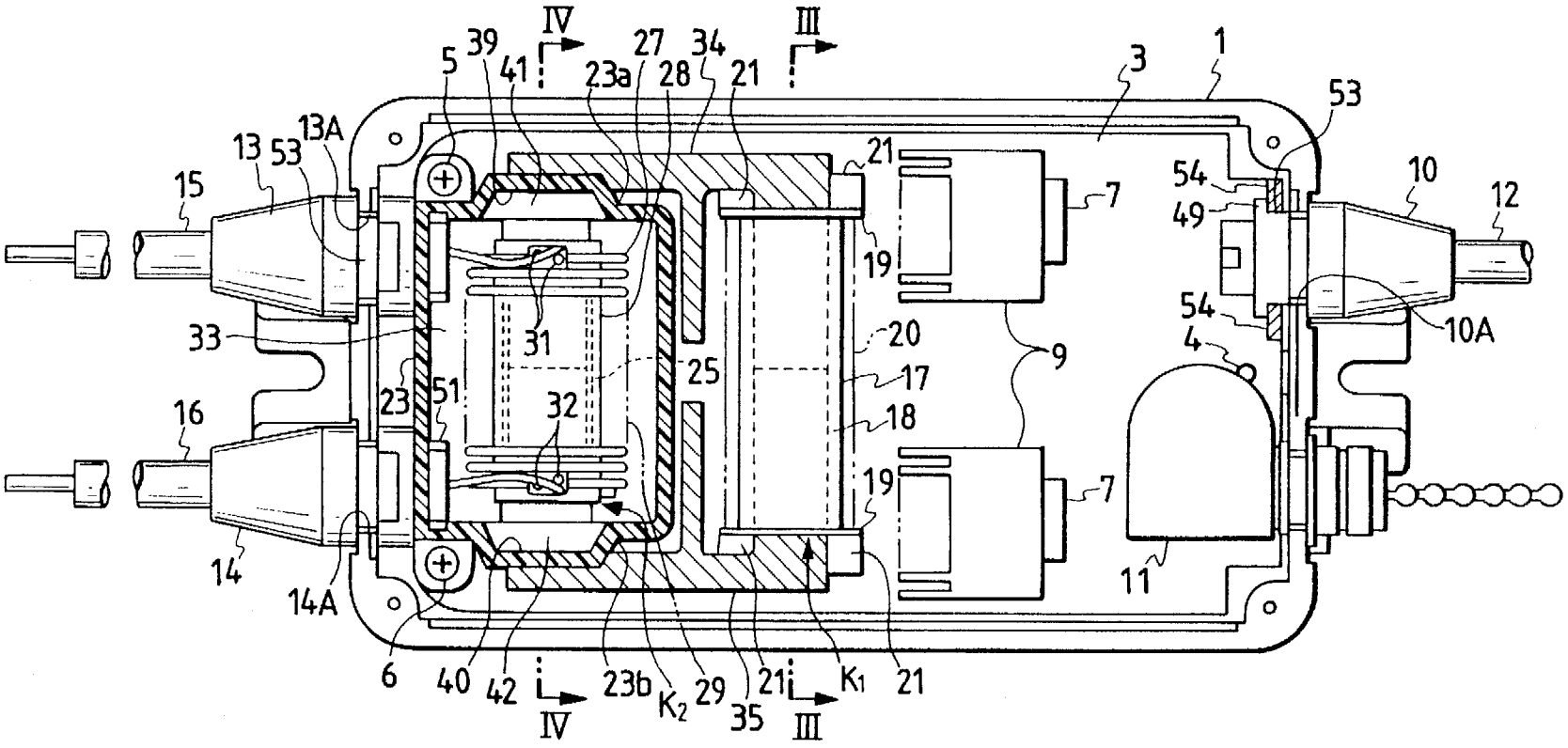
FIG. 1 is a plan view illustrating the interior of a transformer unit according to an embodiment of the present invention.
Figure 2:
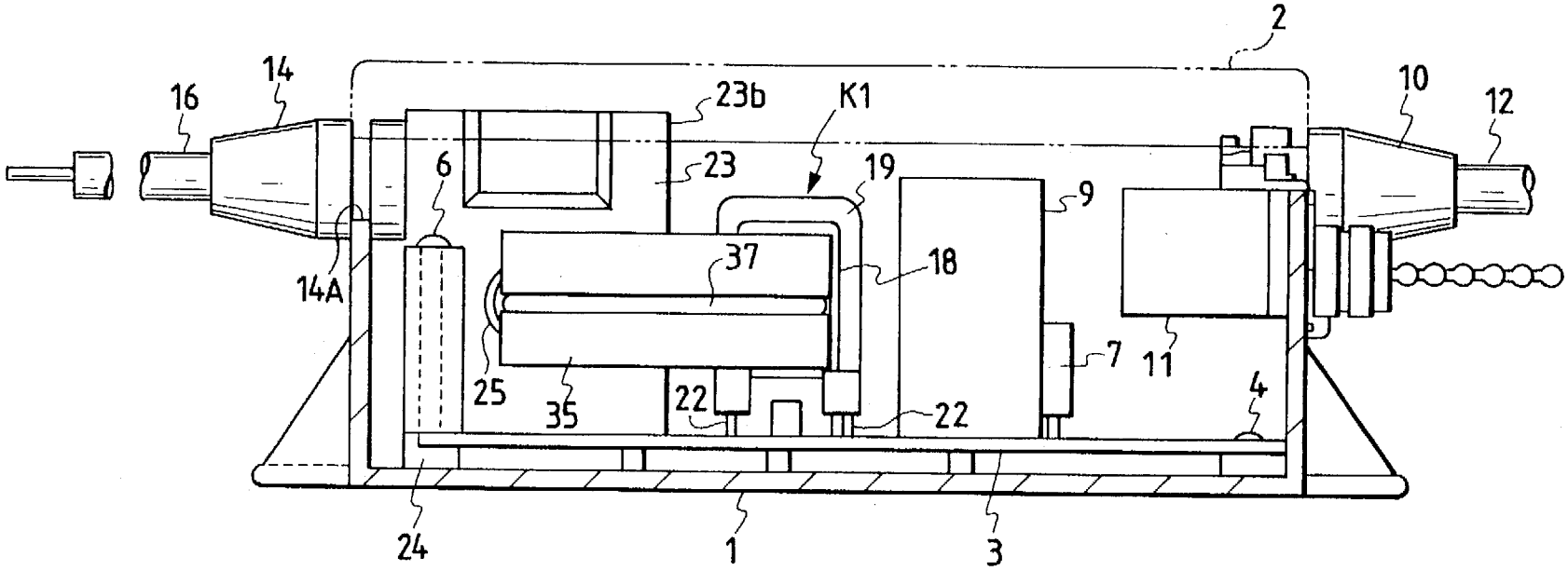
FIG. 2 is a side view of the transformer unit shown in FIG. 1 to illustrate the interior thereof.

Referring to FIGS. 1 and 2, there is shown a transformer unit according to one embodiment of the invention which comprises a main housing 1 in the form of a bottom closed box, the open top side of which is closed by a lid member 2 shown in FIG. 2 only. The lid member 2 is formed with a plurality of vents in the form of slits, not shown.

A print circuit board 3 is threadedly fastened to the inner bottom wall surface of the main housing 1 by screws 4, 5 and 6. Connected to the print circuit board 3 in the vicinity of the center thereof are power transistors 7 each comprising a FET forming part of an inverter circuit. Each of the power transistors 7 has heat dissipating fins 9 secured thereto. Although not shown, various elements such as transistors, capacitors, resistances, etc. other than the power transistors 7 are connected to the the print circuit board 3 from adjacent the center toward the lower portion thereof to complete the inverter circuit.

Further arranged on the print circuit board 3 is a transformer comprising a primary coil K1 as a low-voltage coil, a secondary coil K2 as a high-voltage coil, and ferrite core members 34 and 35. It is to be noted that in this embodiment the arrangement is such that current from a commercial power supply is first rectified, and converted to a high-frequency (several tens of KHz) voltage by an inverter prior to being applied to the primary coil K1 so that the secondary coil K2 may produce a secondary voltage at about 9000 V.

Figure 3:
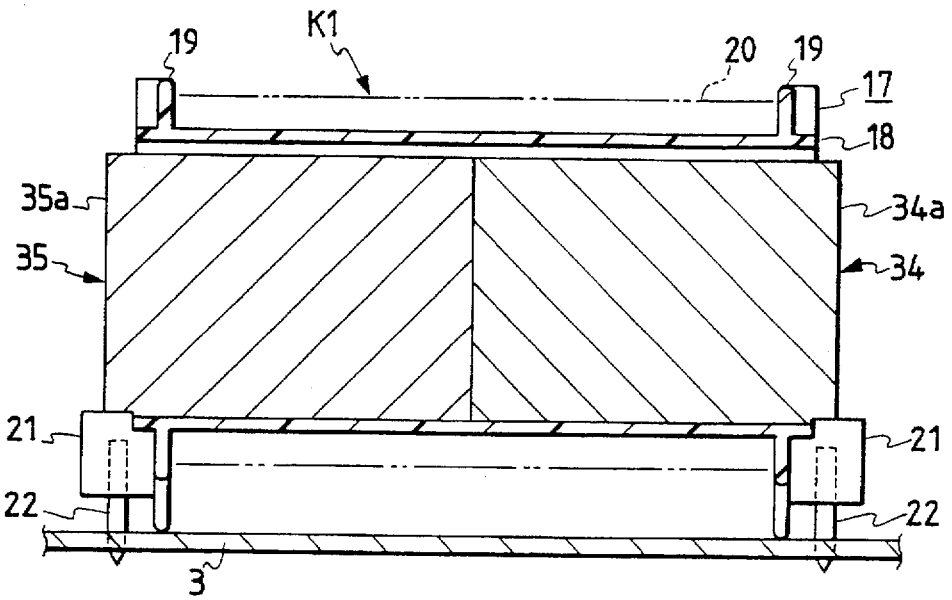
FIG. 3 is a cross-sectional view taken along the line III—III in FIG. 1.

The primary coil K1 will be first described in detail. As shown in FIG. 3, a primary coil bobbin 17 is fixed to the print circuit board 3. The primary coil bobbin 17 comprises a tubular body 18 having a generally square cross-section as seen in FIG. 2 and flanges 19 projecting from the outer periphery of the body 18 adjacent its opposite ends. Wound around the body 18 is primary coil wire 20 having a diameter of 0.5 mm.

The tubular body 18 is provided on the lower wall at four corners thereof with connector portions 21, in each of which a downwardly projecting pin 22 is implanted. The initial end and the terminal end of the primary coil wire 20 are connected with two of the pins 22, respectively by soldering. The four pins 22 are penetrated into the print circuit board 3 whereby the primary coil bobbin 17 is fixed relative to the print circuit board 3. The pair of pins 22 which are connected with the primary coil wire 20 are in turn connected with the high-frequency output of an inverter circuit (not shown) on the print circuit board 3.

Figure 5:
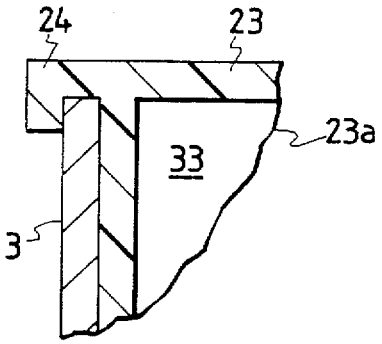
FIG. 5 is a cross-sectional view illustrating the manner in which the locating projection is engaged with the print circuit board.
Figure 8:
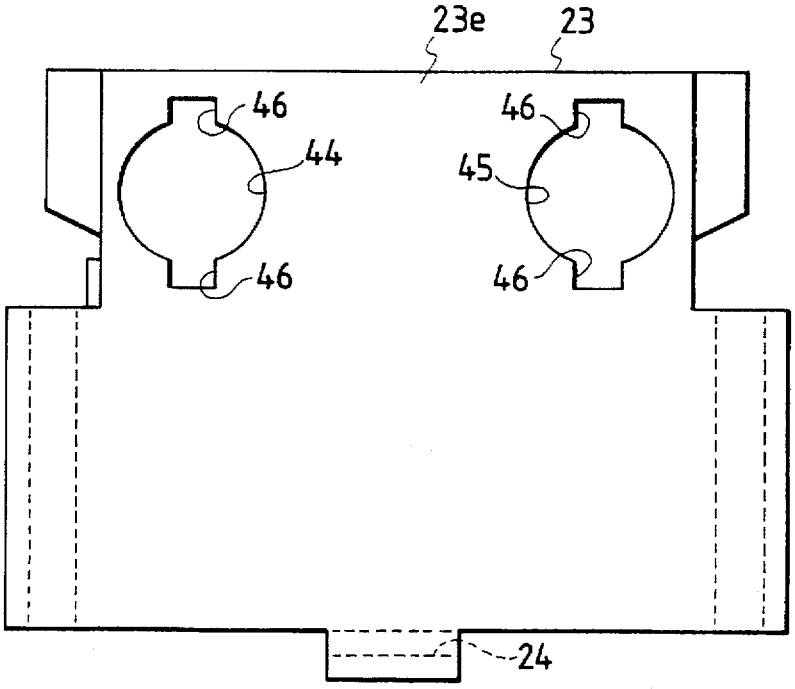
FIG. 8 is a side view of the coil case showing the bushing receiving holes.

The secondary coil K2 will now be described in detail. As shown in FIGS. 1 to 3, a coil case 23 formed of ABS resin is disposed on the print circuit board 3 adjacent the rear side thereof and is threadedly fixed at the rear corner edges of the rear side wall of the case to the print circuit board 3 by the aforesaid screws 5 and 6. The coil case 23 is in the form of a bottom closed box having an opening at the top side. As seen in FIGS. 2 and 8, the coil case 23 has hook-shaped positioning projections 24 extending from the back or outer surface of the bottom wall thereof. The hook-shaped positioning projections 24 are engageable with the side edges of the print circuit board 3 as best shown in FIG. 5 to position the coil case 23 in an upward-downward direction.

As shown in FIG. 8, the rear side wall 23*e* of the coil case 23 has bushing receiving holes or slots 44, 45 formed therethrough in the upper portion at opposite sides, the bushing receiving holes 44, 45 each having a pair of vertically extending diametrically opposed cutouts 46.

Figure 4:
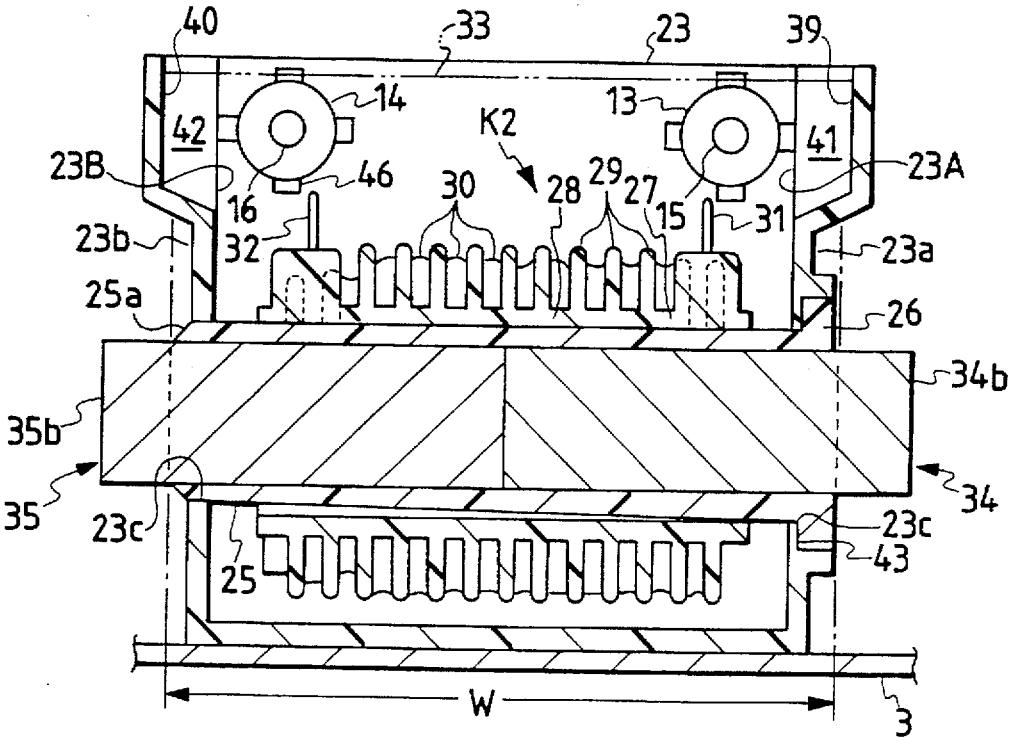
FIG. 4 is a cross-sectional view taken along the line IV—IV in FIG. 1.

As shown in FIGS. 1 and 4, the left and right side walls 23*a* and 23*b* of the coil case 23 have aligned mounting holes 23*c*, 23*c* formed therethrough below the center thereof. Fitted in and extending between the aligned mounting holes 23*c*, 23*c* is a tubular support member 25 having a generally square cross-section and an outer peripheral surface slightly tapering from its proximal end toward the distal end so as to progressively decrease in diameter and a radially outwardly extending flange-like stop 26 adjacent the proximal end. The tubular support member 25 is press fitted in the mounting holes 23*c*, 23*c* to form tight seals between the tubular support member 25 and the mounting holes 23*c* along their joints, thus preventing the insulating compound, which will be filled, later, in the coil case 23, from leaking out through the mounting holes 23. The tubular support member 25 is formed at its distal end with a tapered portion 25*a* to facilitate the insertion of the tubular member into the holes 23*c*, 23*c*. With the tubular support member 25 press fitted in the holes 23*c*, 23*c*, the tapered portion 25*a* projects beyond the side wall 23*b*.

The mounting holes 23*c*, 23*c* have different sizes and the tubular support member 25 have correspondingly different equivalent diameters at its opposite ends. It is thus seen that the mounting holes 23*c*, 23 may be sealed to the opposite ends of the tubular support member 25 by press fitting the tubular member in the holes 23*c*, 23*c*. Consequently, there is virtually no possibility of the insulating compound filled in the coil case 23 leaking out through the mounting holes 23*c*, 23*c*. The flange-like stop 26 extending circumferentially around the tubular support member 25 adjacent its proximal end is engageable with a shoulder formed in the outer surface of the right side wall 23*a* to position and lock the tubular support member 25 relative to the side wall 23*a*.

Within the coil case 23, the tubular support member 25 supports the secondary coil K2 surrounding it. Specifically, the secondary coil K2 includes a secondary coil bobbin 27 consisting of a generally cylindrical tubular body 28 having a plurality (twelve in the illustrated embodiment) of spaced apart flanges 29 extending from the outer periphery thereof to define split coil bobbin sections 29A therebetween, and secondary coil wire 30 having a diameter of about 0.05 mm to 0.1 mm is wound around the body 28 between adjacent flanges 29.

Figure 4A:
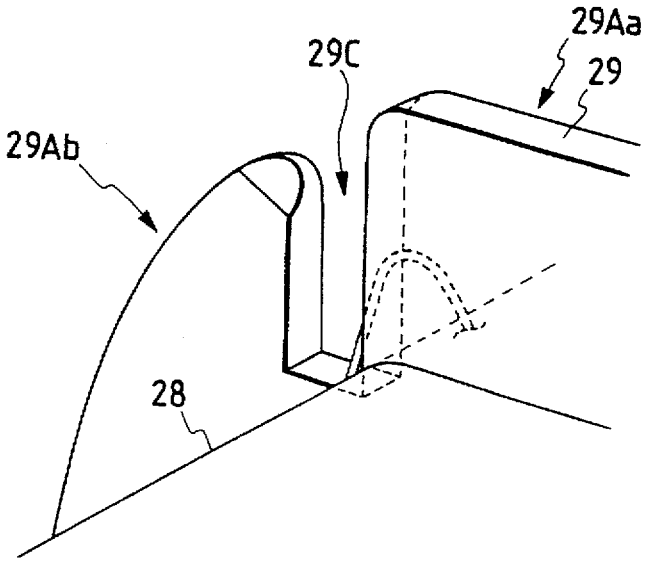
FIG. 4A is a perspective view of one of the flanges of a split-winding secondary coil bobbin showing the configuration of the communicating groove formed through the flange.
Figure 7:
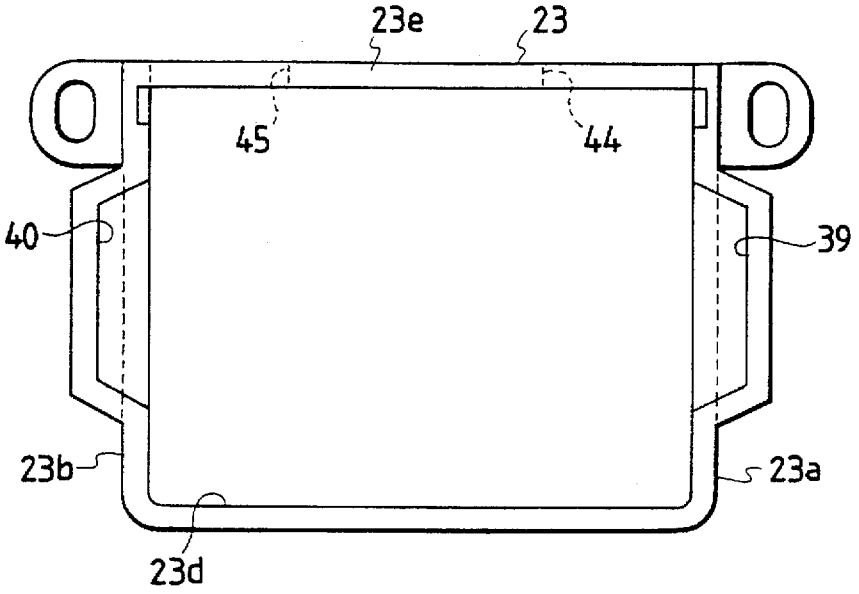
FIG. 7 is a plan view of the coil case.

As shown in FIG. 4A, each of the flanges 29 has a communicating groove 29C through which wire (not shown) in multiple layers wound around a coil bobbin section 29Aa extends to the next adjacent coil bobbin section 29Ab around which the wire is wound in multiple layers. The bobbin 27 has terminal pins 31 and 32 for high-voltage output extending therefrom adjacent the opposite ends thereof, respectively. The wire is thus wound around split coil bobbin sections 29A from the pin 31 at one end to the pin 32 at the other end of the bobbin. Then, the split-winding coil bobbin 27 having a winding therearound is insulated by impregnating the winding under vacuum with a low viscosity resin such as epoxy varnish, polyester varnish, polybutadiene varnish or the like.

The initial end and the terminal end of the secondary coil wire 30 are wound around and connected to the pins 31 and 32, respectively, by soldering, as are the ends of secondary lead wires 15 and 16 extending into the main housing 1. The secondary coil bobbin 27 with the secondary coil wire 30 wound therearound is impregnated with varnish before it is mounted in the coil case 23 by means of the tubular support member 25.

A pair of overhang wall portions 39, 40 having a trapezoidal cross-section are joined to the top edges of the side walls 23*a* and 23*b*, respectively of the coil case 23 in facing relation to the high-voltage terminal pins 31, 32 so as to project beyond the opposite ends of the tubular support member 25 axially thereof and outwardly of the case 23.

With this construction, the distances (gaps) between the high-voltage terminal pins 31, 32 and the corresponding side walls 23*a* and 23*b* are increased to thereby facilitate the operation of connecting the lead wires 15, 16 to the respective terminal pins 31, 32. In addition, the creeping distances from the terminal pins 31, 32 to the adjacent transformer cores 34, 35 along the opposed side surfaces of the corresponding side walls 23*a* and 23*b* are increased to thereby minimize the possibility of abnormal discharging.

The spaces around the secondary coil bobbin 27 and tubular support member 25 are filled with insulating compound 33 composed of a low-viscosity resin (such as epoxy) and a filler (insulating particles such as siliceous sand). Such insulating compound is introduced into the coil case 23 and is then allowed to cure in a predetermined period of time, whereupon it will bond integrally to the coil case 23. The insulating compound 33 will fill the gaps between adjacent sections of the split-winding secondary coil K2 as well as covering the entire outer periphery of the coil to thereby improve the insulation of the secondary coil K2. In addition, that portion of the insulating compound 33 which has filled the spaces defined by the overhang wall portions 39, 40 provide extended insulation portions 41, 42 to insure adequate dielectric strength around the respective terminals 31, 32 of the the secondary coil K2.

Inserted in the tubular support member 25 are the lower legs (defining secondary core segments 34*b* and 35*b*) of a pair of opposing E-shaped cores 34 and 35 as will be described hereinafter. The opposing ends of the lower legs abut against each other as shown in FIGS. 1 and 4 to form a magnetic circuit. Accordingly, as seen in FIG. 4, the tubular support member 25 should not be longer than the sum W of the lengths of the secondary core segments 34*b* and 35*b*. If the overhang wall portions 39, 40 were not provided, the inner surfaces of those portions of the side walls 23*a* and 23*b* of the coil case 23 opposing the high-voltage terminals 31, 32, would extend along straight extension lines 23A and 23B, respectively, so that the axial distance between the inner surfaces could be at the most approximately equal to the length of the tubular support member 25.

Likewise, the length of the secondary coil K2 must be shorter than the length W of the secondary core. However, as the secondary coil is made longer to increase the number of turns of wire, the high-voltage terminals 31, 32 are closer to the side walls 23*a* and 23*b*, thereby not only making it troublesome to connect the lead wires 15, 16 to the respective terminal pins 31, 32, but also shortening the creeping distances going along the opposed side surfaces of the side walls 23*a* and 23*b* to the adjacent transformer cores 34, 35 so that it will be difficult to insure that abnormal discharging is prevented from occurring between the high voltage terminals 31, 32 and the cores 34, 35.

According to this invention, however, those portions 39, 40 of the side walls 23*a*, 23*b* which face the high-voltage terminals 31, 32 are arranged to project outwardly to increase the distances between the terminals 31, 32 and the side walls 23*a*, 23*b*, as described above with reference to the embodiment of FIG. 4, whereby not only the work spaces available for connecting the lead wires 15, 16 to the respective terminal pins 31, 32 are expanded, but also the creeping distances from the terminal pins 31, 32 to the adjacent magnetic cores 34, 35 are extended to prevent abnormal discharging more positively.

Figure 6:
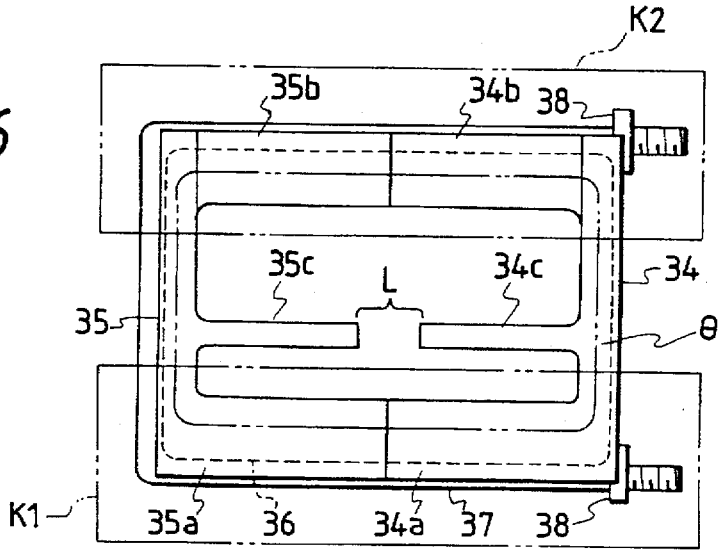
FIG. 6 is a plan view illustrating the manner in which the transformer cores are assembled together.

The opposed legs of a pair of split ferrite cores 34, 35 are inserted in the body 18 of the bobbin 17 of the primary coil K1 and the tubular support member 25 for the secondary coil K2 from the opposite ends thereof. As shown in FIG. 6, the ferrite cores 34 and 35 are in the shape of E in a plan view, and consist of primary core segments 34*a*, 35*a*, secondary core segments 34*b*, 35*b*, and leakage core segments 34*c*, 35*c*, respectively. The ferrite cores 34, 35 have continuous grooves 36 around their outer peripheral surfaces in which a generally U-shaped (as viewed in plan) clamp member 37 is received. Nuts 38 are threadedly tightened on the opposite ends of the U-shaped clamp member 37 to clamp the ferrite cores 34 and 35 together in abutting relation. The opposing ends of the primary core segments 34*a* and 35*a* and of the secondary core segments 34*b* and 35*b* are thus joined in an end-to-end relation to form a closed magnetic circuit as indicated by broken lines θ. It is noted that the leakage core segments 34*c* and 35*c* are spaced apart from each other by a gap L which determines the upper limit of the current (saturation current) flowing through the secondary coil K2.

Mounted on the front side wall of the main housing 1 is a switch 11 for supplying electric power to the transformer unit. Received in a U-shaped opening 10A provided in the top edge of said front side wall is a primary bushing 10 made of synthetic resin through which is passed a primary lead wire 12 comprising a coaxial cable. The end of one line of the primary lead wire 12 is connected to the switch 11 within the main housing 1 while the end of the other line of the lead wire is connected to the aforesaid inverter circuit through the print circuit board 3.

The rear side wall of the main housing 1 is formed in the top edge with a pair of spaced apart U-shaped openings 13A and 14A in which secondary bushings 13 and 14 both made of synthetic resin are fitted, respectively. Extending through the bushings 13 and 14 are the secondary lead wires 15 and 16 on the load side, respectively. The ends of the lead wires 15 and 16 are connected to the terminal pins 31 and 32, respectively of the secondary coil K2 within the main housing 1. The lead wires 12, 15 and 16 are fixedly secured to the respective bushings 10, 13 and 14 by welding the wire coatings to the bushings, which are in turn supported by being held between the main housing 1 and the lid member 2 when the latter is fastened to the former.

Figure 9:
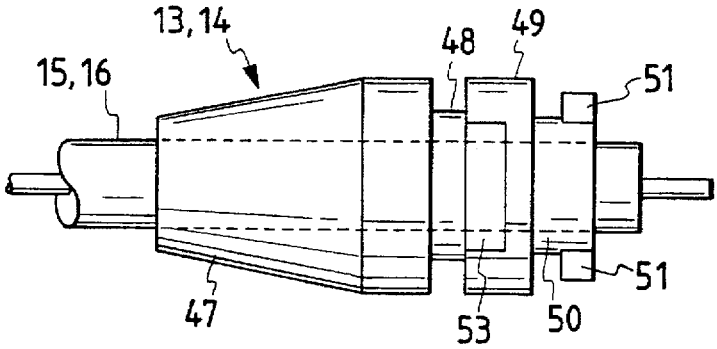
FIG. 9 is a side view of the bushing.
Figure 10:
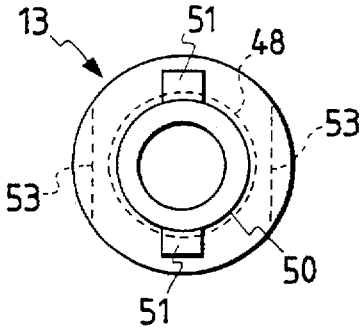
FIG. 10 is a front view of the bushing.

As shown in side and front views in FIGS. 9 and 10, respectively, each of the bushings 13 and 14 comprises a body portion 47 adapted to abut against the outer surface of the rear side wall of the main housing 1, a reduced diameter intermediate portion 48 adapted to fit in the corresponding one of the U-shaped openings 13A, 14A formed in the rear side wall of the main housing 1, and a sealing flange 49 engageable in abutment against the outer surface of the rear side wall 23*e* of the coil case 23. Further, each of the bushings 13 and 14 has a reduced diameter end portion 50 adapted to be inserted through the corresponding one of the U-shaped openings 13A, 14A formed in the rear side wall of the aforesaid bushing receiving holes 44, 45 in the rear side wall 23*e* of the coil case 23, said end portion 50 having a pair of diametrically opposed locking lugs 51 extending therefrom in a spaced relation with the flange 49. The locking lugs 51 are adapted to pass through the opposed cutouts 46 of the bushing receiving hole 44 or 45.

Figure 11:
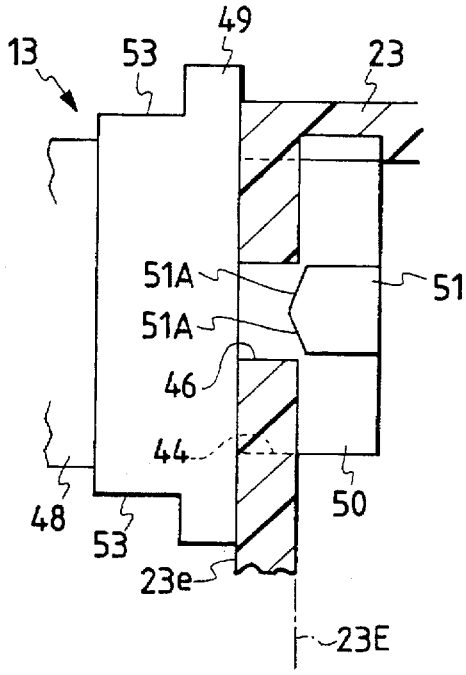
FIG. 11 is a side view illustrating the manner in which the bushing is engaged with the coil case.
Figure 12:
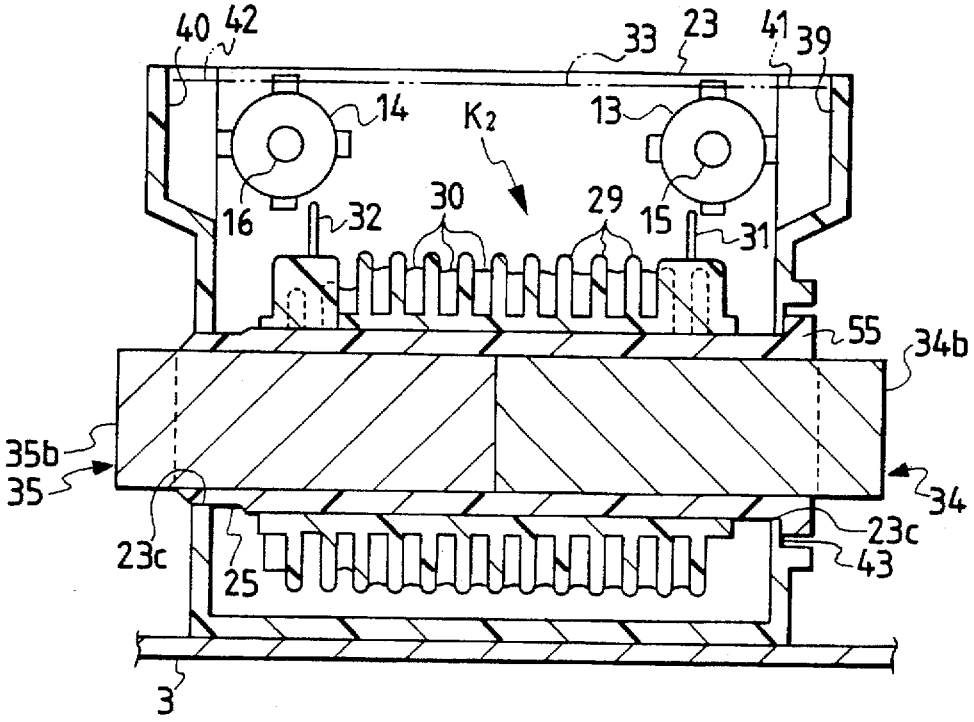
FIG. 12 is a cross-sectional view of a coil case according to another embodiment of the invention.

As illustrated in FIG. 11, the rear side wall of each of the locking lugs 51 is formed with a pair of tapered surfaces 51A rearwardly converging to an apex. The tapered surfaces 51A are arranged to intersect the plane 23E of the inner surface of the side wall 23*e* when the flange 49 is in abutting engagement with the outer surface of the side wall 23*e*. With this arrangement, the reduced diameter distal end portion 50 of the bushing 13 is inserted through the bushing receiving hole 44, and then as the bushing 13 is rotated, the tapered surfaces 51A of the lugs 51 are forced to move over the corresponding edges of the cutouts 46 onto the inner surface of the side wall 23*e* whereupon the apices of the tapered surfaces 51A act to push against the inner surface of the side wall 23*e* in a rearward direction, which in turn press the flange 49 against the outer surface of the side wall 23*e* to thereby seal off the bushing receiving hole 44 and its cutouts 46. It is thus insured that the insulating compound 33 poured in the coil case 23 is prevented from leaking through the bushing receiving hole 44 and its cutouts 46.

While the bushing 10 is of a construction similar to that of the bushings 13 and 14, it is mounted in the U-shaped opening or notch 10A in the front side wall of the main housing 1 in contrast to the bushings 13 and 14 being connected to the coil case 23. The flange 49 is formed on the outer periphery thereof with a pair of opposed flat portions 53 to prevent rotation. In the case of the primary bushing 10, the flat portions 53 are arranged to engage with a pair of detents 54 extending from the lid member 2 into the main housing 1 to prevent rotation of the bushing when the lid member is closed. Although the secondary bushings 13 and 14 are also provided with similar flat portions for preventing rotation, they are allowed, before filling the insulating compound 33, to rotate because no detent is provided at corresponding locations in the main housing 1. After the insulating compound 33 is filled and cured, the locking lugs 51 and flat portions 53 are immobilized in the cured compound, preventing the bushings 13, 14 from being rotated.

The procedures for assembling the transformer unit will now be described.

First, a varnish impregnated secondary coil K2 is placed in a coil case 23, and a tubular support member 25 is then inserted through the coil case 23 and the secondary coil K2 and is press fitted in the mounting holes 23*c*. Then, the end portions 50 of secondary bushings 13 and 14 having secondary lead wires 15 and 16, respectively extending therethrough are inserted in the respective bushing receiving holes 44 and 45, respectively and rotated about 90°, whereby the locking lugs 51 are forced to engage against the inner surface of the side wall 23*e*, which in turn presses the flange 49 against the outer surface of the side wall 23*e* to thereby seal off the bushing receiving holes 44, 45 and their cutouts 46. The initial end and the terminal end of the secondary coil wire 30 as well as the ends of the secondary lead wires 15, 16 are then connected to the terminals 31, 32 by soldering.

The next step is to fill the spaces in the coil case 23 around the secondary coil K2 and small exposed areas of the coil bobbin 27 and tubular support member 25 in the coil case 23 with liquid insulating compound 33, and to allow the compound to cure in a short time to enhance the insulation of the secondary coil K2. Thereafter, the primary core segments 34*a*, 35*a* of the E-shaped magnetic cores 34, 35 are inserted in the tubular body 18 of the primary coil bobbin, and the secondary core segments 34*b*, 35*b* are inserted in the tubular support member 25 to assemble a transformer. Then, the locating projections 24 are engaged with the print circuit board 3 to position the coil case 23 in a horizontal direction, and the coil case 23 is fastened to the main housing 1 through the print circuit board 3 by means of screws 5, 6.

As described above, in this embodiment the secondary coil K2 is encapsulated in insulating compound 33 only within the coil case 23 in contrast to the prior art, requiring a significantly reduced quantity of insulating compound, and hence reducing the weight of the transformer unit. Since the insulating compound 33 encapsulating the secondary coil K2 defines outwardly expanded insulation portions 41, 42 surrounding the terminals 31, 32 of the secondary coil K2 that is a high-voltage coil, the expanded insulation portions 41, 42 would insure an adequate creeping distance from the terminals 31, 32, should the insulating compound 33 be dislodged from the wall of the coil case 23. In addition, the enlarged spaces defined by the overhang wall portions 39, 40 provide a sufficient work space for soldering the ends of the secondary lead wires 15, 16 and the initial and terminal ends of the secondary coil wire 30 to the terminals 31, 32 prior to pouring the insulating compound 33, thereby enhancing the working efficiency.

Since the stop 26 of the tubular support member 25 is sealingly engaged with the shoulder 43 of the coil case 23 and the receiving holes 44, 45 are sealed off by the bushings 13, 14, there is substantially no possibility of the insulating compound 33 leaking through the mounting holes 23*c* or receiving holes 44, 45 prior to curing. Accordingly, the possibility is minimized that the level of liquid insulating compound in the coil case 23 may drop due to leakage, which might result in poor insulation.

Furthermore, the working efficiency may be enhanced and yet the number of rejected parts may be reduced, as compared with the practice of sealing the gaps around the mounting holes 23*c* and receiving holes 44, 45 with adhesives or the like.

In addition, should even a small amount of insulating compound 33 leak through gaps between the tubular support member 25 and the mounting hole 23*c* of the coil case 23, the leaked insulating compound would flow along the outer peripheral contour of the tapered portion 25*a* and prevented from entering the interior of the tubular support member 25. It is thus possible to avoid insulating compound from sticking and curing on the inner wall of the tubular member, which might otherwise interfere with the subsequent operation of inserting the secondary core segments 34*b*, 35*b* in the tubular support member 25.

It is now noted that with the split-winding coil bobbin 27 of the secondary coil K2, the wire sections wound in multiple layers around the coil bobbin sections 29Aa and 29Ab on the opposite sides of each flange 29 may possibly bend in a direction to fill the space in the communicating groove 29C. Upon pouring of insulating compound, if any bubbles should be trapped between the split-wound coils around the adjacent coil bobbin sections 29Aa and 29Ab with the wires of the adjacent split-wound coils having bent toward each other in the communicating groove 29C, it would disadvantageously be impossible to maintain a positive insulation between such closely spaced split-wound coils.

There is also a possibility that bubbles may remain around that portion of the wire bridging across the communicating groove 29C from one coil bobbin section 29Aa to the adjacent coil bobbin section 29Ab. Again in that case, it would disadvantageously be impossible to maintain a positive insulation between that portion of the wire extending through the communicating groove 29C and the split-wound coil wound in multiple layers around the coil bobbin section 29Aa or 29Ab.

According to another aspect of the invention, there is provided an improved coil bobbin to overcome the foregoing drawbacks. An embodiment of such improved coil bobbin is illustrated in FIGS. 13–15 in which the elements similar to those in the embodiment shown in FIGS. 1–12 are indicated by like reference numbers.

Figure 13:
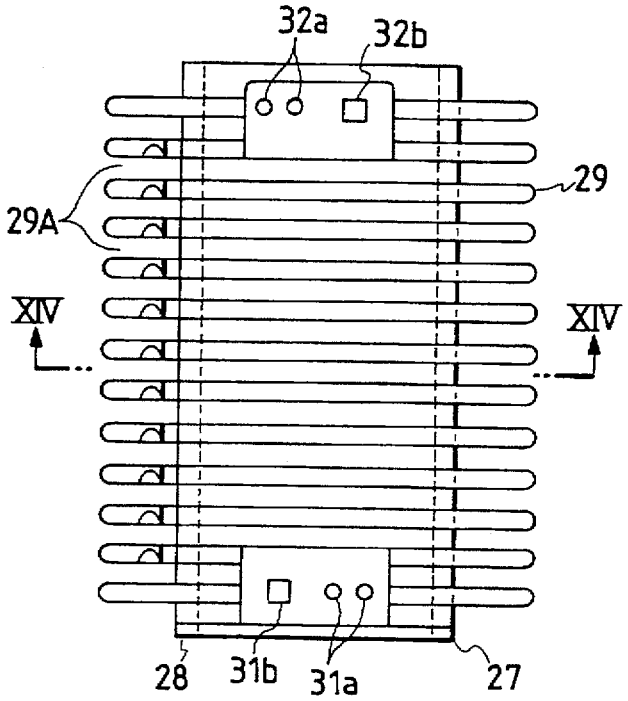
FIG. 13 is a plan view of a coil bobbin according to an embodiment of the invention.

In FIG. 13, the coil bobbin 27 comprises a generally cylindrical tubular body 28 around which wire is wound in split-winding sections, and a plurality of spaced apart parallel integral flanges 29 extending from the outer periphery of the body 28 to define split coil bobbin sections 29A therebetween.

The coil bobbin 27 has locking terminal pins 31*b* and 32*b* in the form of a square prism extending therefrom adjacent the opposite ends thereof, respectively, and further has a pair of cylindrical pins 31*a* and 32*a* extending therefrom adjacent each end thereof. The initial end and the terminal end of the wire 30 wound around the coil bobbin sections 29A are wound several turns around the locking terminal pins 31*b* and 32*b*, respectively prior to being fastened round the pairs of cylindrical pins 31*a* and 32*a*, respectively. Lead wires (not shown) are soldered to the two cylindrical pins 31*a* and 32*a* at the opposite ends of the coil bobbin 27 and extend out of the coil case 23.

Figure 14:
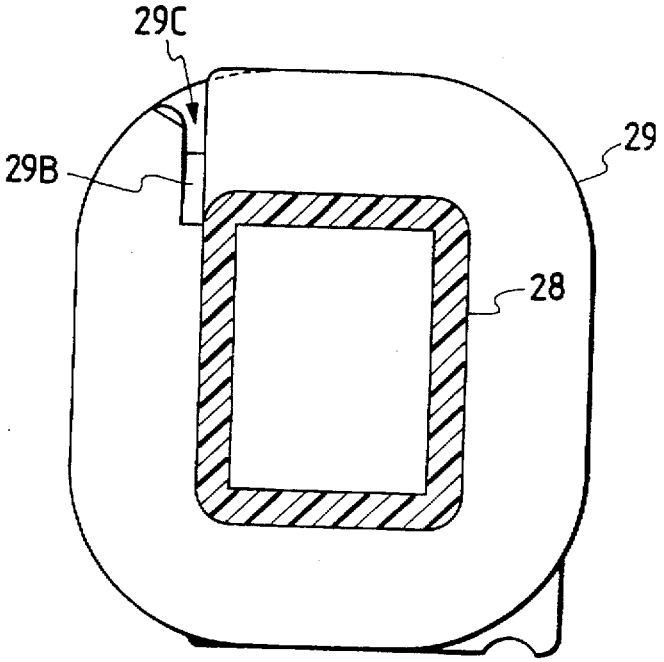
FIG. 14 is a cross-sectional view taken along the line XIV—XIV in FIG. 13 showing one of the flanges on the coil bobbin and a communicating groove formed in the flange.
Figure 15:
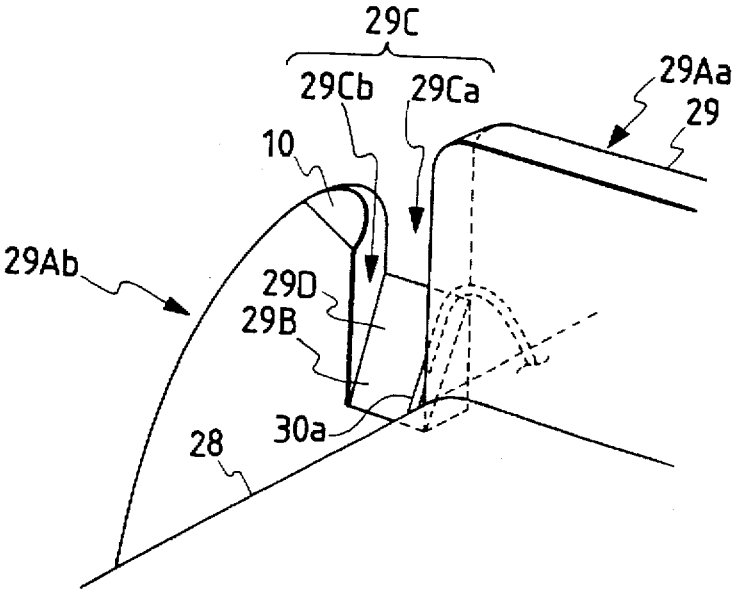
FIG. 15 is a perspective view of the flange and the communicating groove in FIG. 14 as viewed from the side surface of the flange opposite to the side surface in FIG. 14.

As shown in FIG. 14, each flange 29 is formed in one side surface thereof with a communicating groove 29C progressively increasing in depth in a tangential direction from adjacent the body 28 to the outer periphery of the flange and communicating with the opposite side surface radially inwardly of the outer periphery. More specifically, as illustrated in FIG. 15, the communicating groove 29C comprises a notch portion 29C*a* extending from the outer periphery of the flange 29 inwardly to about a midpoint between the outer periphery and the body 28, and a bottomed groove portion 29C*b* having a bottom defined by a ramp 29B extending from the midpoint to the body 28.

The wall defining the bottom of the groove portion 29C is configured in the form of a triangular prism and constitutes a partition 29D separating the adjacent coil bobbin sections 29Aa and 29Ab from each other. Extending through the communicating groove 29C is the connecting wire portion 30*a* connecting from the winding end of the wire in the uppermost one of multiple layers wound around the coil bobbin section 29Aa to the winding start of the wire in the lowermost one of multiple layers wound around the adjacent coil bobbin section 29Ab. It is to be appreciated that the connecting wire portion 30*a* will not interfere with the side edge of any winding layer being wound around the adjacent coil bobbin section 29Ab to thereby permit the wire to be wound such that the side edges of the wire in all of the layers may be in alignment in a radial plane.

The wire 30 is wound in multiple layers around the coil bobbin sections 29A successively from the high-voltage terminal pins 31*a* and the locking terminal 31*b* at one end of the bobbin to the high-voltage terminal pins 32*a* and the locking terminal 32*b* at the other end. The initial end and the terminal end of the wire 30 are tied round the pairs of cylindrical pins 31*a* and 32*a*, respectively. Each adjacent pair of coil bobbin sections 29Aa and 29Ab are connected together by the connecting wire portion 30*a* extending through the communicating groove 29C. The coil bobbin 27 having the wire 30 thus wound therearound is then placed in a coil case 23 as shown in FIGS. 1, 2 and 4. Then, insulating compound is poured at a normal pressure to fill the coil case and allowed to cure.

With this construction of the coil bobbin 27, the gap between the partition 29D in the communicating groove 29C and the side edge of the bundle of wire wound around the coil bobbin section 29Ab is so narrow that when varnish is impregnated in between the wire turns prior to pouring of insulating compound, a portion of the varnish may also penetrate into and fill the gap. Consequently, when the coil case is subsequently filled with insulating compound, bubbles are much less likely to accumulate in the communicating groove 29C as compared with the prior art. Because of the unlikelihood of bubbles to form in the communicating groove 29C, it is insured that positive insulation is maintained between the adjacent split-wound coils facing the communicating groove 29C by the insulating compound. In addition, the partition 29D aids to maintain positive insulation between those portions of the wire bundles around the adjacent coil bobbin sections 29Aa and 29Ab facing the communicating groove 29C by separating the adjacent wire bundles from each other. Still another advantage is that the pouring of insulating compound may be carried out at a normal pressure owing to the unlikelihood of bubbles to accumulate in the communicating groove 29C.

Furthermore, should the wire break between the high-voltage terminal pins 31*a* and the locking terminal 31*b*, for example, the repair might be easily made by unwinding the extra several turns of wire wound around the locking terminal 31*b* and re-connecting the unwound extra length of wire between the pins 31*a* and the locking terminal 31*b*.

Figure 16:
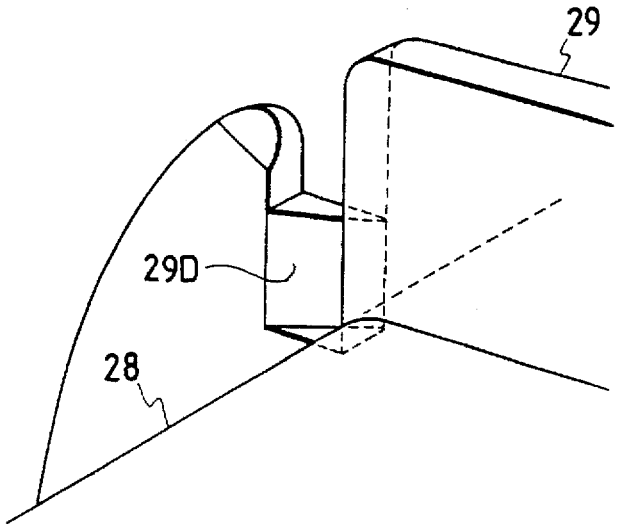
FIG. 16 is a perspective view of another embodiment of the communicating groove.

While the partition 29D in the communicating groove 29C is formed in the shape of a triangular prism decreasing in thickness progressively radially outwardly of the flange 29 in the embodiment of FIGS. 14–15, it is within the scope of the invention to provide the partition 29D in the shape of a triangular prism decreasing in thickness progressively circumferentially of the flange 29 as illustrated in FIG. 16.

Figure 17:
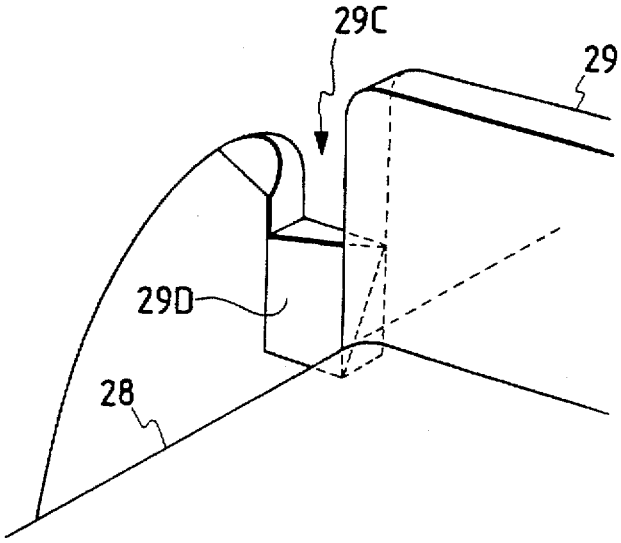
FIG. 17 is a perspective view of yet another embodiment of the communicating groove.

In a further modified form of the partition 29D, the portion of the partition 29D joining the inner end of the communicating groove 29C may be formed to have the same thickness as that of the flange 29 as illustrated in FIG. 17.

Further, while the outer peripheries of the tubular body 28 and flanges 29 of the coil bobbin 27 are shown as being circular in the embodiments described above, they may be square-shaped or of any other polygonal shape.

As indicated above, in the transformer unit according to the present invention, only the secondary coil K2 which is a high-voltage coil is accommodated in the coil case 23 and encapsulated in insulating compound 33, whereby the weight of the transformer unit may be reduced as compared with the prior art. In addition, since the secondary coil K2 may be insulated with a relatively small amount of insulating compound 33 filled in the coil case 23, it is possible to reduce the time of curing the insulating compound 33, and hence improving the manufacturing efficiency.

With the construction of the coil case 23 used in this transformer unit, the secondary coil K2 is supported on the tubular support member 25 having a magnetic core fitted therein, and the tubular support member 25 is in turn press fitted in the mounting holes 23*c* formed through the opposed side walls of the coil case 23 to prevent the leakage of insulating compound. Moreover, those portions of the side walls of the coil case facing the high-voltage terminals of the secondary coil K2 are extended outwardly to increase the distances from the high-voltage terminals to thereby provide sufficient work space for soldering lead wires at the same time to minimize the possibility of abnormal discharging. With the construction of the coil bobbin used in this transformer unit, the partition 29D provided in the communicating groove 29C in each of flanges defining split coil bobbin sections serves to prevent discharging across the communicating groove between the adjacent split-winding sections.

We claim:

1. A transformer unit comprising:

a magnetic core means forming a magnetic circuit;

a primary coil mounted around said magnetic core means, and a secondary coil spaced along said magnetic core means away from said primary coil and mounted around said magnetic core means, said secondary coil having opposite ends, and said magnetic core means, primary coil and secondary coil constituting a high-voltage transformer;

a box-like coil case enclosing only said secondary coil and that portion of said magnetic core means around which the secondary coil is mounted, said coil case having a side wall through which first and second openings are formed;

insulating compound filling only the interior space of said coil case;

a main housing containing said transformer and coil case, said main housing being free of said insulating compound and having a side wall through which first and second openings are formed; and first and second lead-out means for supporting first and second lead wires, respectively connected to the opposite ends of said secondary coil and guiding said lead wires out of said coil case and main housing.

2. The transformer unit according to claim 1, wherein said coil case has a pair of opposed side walls through which first and second aligned mounting holes are formed, and further comprising a tubular support member inserted through said first and second mounting holes in a sealing relation to the holes, said tubular member having an outer periphery and opposite ends, said portion of the magnetic core means being inserted in said tubular support member, and said secondary coil having high-voltage terminals at the opposite ends and being mounted around the outer periphery of said tubular support member.

3. The transformer unit according to claim 2, wherein said opposed side walls of the coil case have wall portions facing said high-voltage terminals, said wall portions extending axially outwardly of the opposite ends of said tubular member, whereby the distances between said high voltage terminals and said corresponding wall portions are increased and the insulating compound therebetween is increased in thickness.

4. The transformer unit according to claim 2, wherein said first mounting hole is greater in diameter than said second mounting hole, said tubular support member having an outer diameter greater at the first mounting hole than at the second mounting hole.

5. The transformer unit according to claim 4, wherein said tubular support member has a flange at one end thereof adjacent said first mounting hole, said flange being adapted to sealingly abut against an outer wall surface of one of said opposed side walls of the coil case.

6. The transformer unit according to claim 3, 4 or 5, wherein said magnetic core means comprises first and second E- shaped core members, each core member having upper and lower legs and a central leg, one of the upper and lower legs of the first core member and one of the upper and lower legs of the second core member being inserted in said tubular support member in an end-to-end abutting relation, the other of the upper and lower legs of the first core member and the other of the upper and lower legs of the second core member being inserted in said primary coil in an end-to-end abutting relation, and the central legs of the first and second core members being positioned in opposed spaced apart relation.

7. The transformer unit according to claim 1, wherein said lead-out means include first and second bushing means for receiving and supporting said first and second lead wires, respectively centrally therein, said first and second bushing means fitted in and extending through said first and second openings, respectively formed through said side wall of the coil case and said first and second openings, respectively formed through said side wall of the main housing.

8. The transformer unit according to claim 7, wherein each of said first and second bushing means includes an end portion inserted through a corresponding one of said first and second openings of the coil case and extending into said coil case, and a flange positioned behind and spaced away from said end portion, said flange having a diameter greater than that of the end portion and a front end surface adapted to sealingly abut against an outer wall surface of said side wall of the coil case around said first and second openings thereof.

9. The transformer unit according to claim 8, wherein each of said end portions of the first and second bushing means has locking lug means extending from an outer periphery thereof, said locking lug means being adapted to be forced against an inner wall surface of said side wall of the coil case to thereby force said front end surface of the flange against the outer wall surface of said side wall of the coil case.

10. The transformer unit according to claim 1, wherein said secondary coil comprises a coil bobbin having a tubular body and a plurality of spaced apart parallel flanges formed integrally with and extending from an outer periphery of the tubular body to define a plurality of split spaces therebetween, and a plurality of split winding sections continuously wound around said tubular body in the split spaces.

11. The transformer unit according to claim 10, wherein each of said flanges has opposed side surfaces and is formed in one of the side surfaces with a communicating groove having a bottom and extending in a generally tangential direction from adjacent the outer periphery of said tubular body, said bottom of the communicating groove being formed as a partition with a notch extending from the outer periphery of the flange inwardly and communicating with the other of said side surfaces, and each of the split winding sections in one of the split spaces separated each other by said flanges having a wire end extending through the corresponding communicating groove and joining with a wire end of the adjacent split winding section.

* * * * *